US006291751B1

(12) United States Patent
Antaki

(10) Patent No.: US 6,291,751 B1
(45) Date of Patent: Sep. 18, 2001

(54) HARMONICA ENCLOSURE

(76) Inventor: James F. Antaki, 4373 Mt. Royal Blvd., Allison Park, PA (US) 15101

( * ) Notice: Subject to any disclaimer, the term of this patent is extended or adjusted under 35 U.S.C. 154(b) by 0 days.

(21) Appl. No.: 09/692,001

(22) Filed: Oct. 19, 2000

(51) Int. Cl.[7] ..... G10D 7/12
(52) U.S. Cl. ..... 84/377; 84/378
(58) Field of Search ..... 84/377, 378

(56) References Cited

U.S. PATENT DOCUMENTS

| | | | | |
|---|---|---|---|---|
| 712,380 | * | 10/1902 | Hohner | 84/378 |
| 752,295 | * | 2/1904 | Messner | 84/378 |
| 2,407,312 | * | 9/1946 | Magnus | 84/377 |
| 5,182,413 | * | 1/1993 | Epping | 84/377 |

FOREIGN PATENT DOCUMENTS

727957 * 4/1955 (GB) .

* cited by examiner

*Primary Examiner*—Shih-Yung Hsieh
(74) *Attorney, Agent, or Firm*—David V. Radack; Clifford A. Pastel; Eckert Seamans Cherin & Mellott, LLC

(57) ABSTRACT

Enclosures for a harmonica are disclosed wherein the wall of the enclosure surrounds the harmonica, provides a mouthpiece opening and an outlet opening, and forms at least one resonance chamber. A lip groove, a bulge, a cradle and a diffuser are disclosed forming a saddle-shaped surface which is concave along a front-to-back axis and convex around the ends of the enclosure. A key benefit of this arrangement is the improved control of the sound by the player's hands. Another key benefit of this arrangement is the enhanced tone and increased loudness of the sound produced by the harmonica. Supporting members are disclosed that constrain movement of the harmonica relative to the enclosure. Single-piece and multi-piece enclosures are disclosed.

22 Claims, 12 Drawing Sheets

HARMONICA ENCLOSURE

BACKGROUND OF THE INVENTION

1. Field of the Invention

The invention relates to an improved harmonica enclosure which enhances the tone and increases the loudness of the sound produced by the harmonica, and whose ergonomic shape improves the control of the sound by the player's hands.

2. Description of the Prior Art

Existing harmonica covers protect the delicate reeds of the harmonica from damage and dirt and keep the player's lips from touching the reeds and reed slots of the harmonica while in use, and also serve a decorative function. Existing harmonica covers are not optimized for ergonomic or acoustic effects.

SUMMARY OF THE INVENTION

I provide a harmonica enclosure comprising a wall in surrounding relationship to the harmonica. I further provide a first or mouthpiece opening in the enclosure in juxtaposition to the harmonica mouthpiece, and a second or outlet opening in the enclosure remote from the first opening and in communication with the reed slots of the harmonica. I position the wall of the enclosure at a varying distance from the reeds along the breadth of the harmonica. Additionally, I form the outlet opening of varying size along its breadth, being larger at one end than at the other.

I prefer to provide a lip groove in the wall of the enclosure adjacent to the mouthpiece opening of the enclosure and the mouthpiece of the harmonica. I prefer to provide a bulge of greater height and width than the mouthpiece opening, a cradle adjacent to the bulge of lesser height and width than the bulge, and a diffuser adjacent to the cradle of greater height and width than the cradle. The bulge, cradle and diffuser all smoothly curve around each end of the harmonica. The bulge, cradle and diffuser provide a saddle shape to the outer surface of the wall of the enclosure.

I prefer to provide that the enclosure forms at least one resonance chamber between the inner surface of the wall of the enclosure and the harmonica positioned within the enclosure. The inner surface of the wall at the bulge, cradle and diffuser provide room for the resonance chambers. I prefer to provide an outlet opening of lesser height and width than the adjacent diffuser.

I prefer to provide that the enclosure can be formed in one enclosure piece which can be slid or slipped onto the harmonica or off the harmonica. I also prefer to provide that the enclosure can be formed in at least two enclosure pieces which join together by means of snaps and sockets or other joining means to form the enclosure around the harmonica.

I further provide that the enclosure can be used with a harmonica comprising a comb and reed plates but without existing cover plates. Alternatively, I provide that the enclosure, with conforming dimensions of the inner surface of the wall and support members, can be used with a harmonica which includes existing cover plates.

The enclosure permits the mouthpiece of the harmonica to protrude from the mouthpiece opening of the enclosure so that the player's hand or hands can hold the harmonica by holding the enclosure and the player's mouth can contact the mouthpiece of the harmonica and the adjacent portion of the enclosure. The lip groove permits contact of the player's lips with the mouthpiece and lip groove of the enclosure. The front-to-back concavity of the outer surface of the wall helps to position the fingers of the player's hands on the enclosure relative to the mouthpiece of the harmonica and the convexity of the outer surface of the wall around the bass end of the harmonica provides a shape proportioned to fit comfortably between the player's finger and thumb. The harmonica enclosure is ergonomically shaped to facilitate easy gripping by one hand of the player thereby reducing or delaying the fatigue resulting from playing the harmonica.

The harmonica enclosure facilitates the player's use of the harmonica playing technique known as "cupping" in several ways: the enclosure supports the fingers and palms of the player's hands in good cupping position; the bulge, cradle and diffuser form a substantially airtight seal with the player's gripping hand; the outlet opening forms a substantially airtight seal with the player's other hand; the enclosure forms portions of the cup shape which otherwise would have to be formed by the player's hands or supplies portions of the cup shape which cannot be supplied by the player's hands; and the player can easily modify the cup shape to provide a greater range of expression and a more controlled modulation of tone while maintaining the airtight seal.

The assymmetric shape of the enclosure provides visual and tactile indications differentiating the bass end from the treble end of the harmonica that help prevent the player from inadvertently playing the harmonica with the positions of the bass end and treble end reversed.

The enlarged, bell-shaped portion of the resonance chamber provided by the diffuser amplifies the sound produced by the harmonica and improves acoustic impedance matching. The constricted outlet opening shapes the sound and provides acoustic back pressure.

The enclosure formed of one enclosure piece can be slid or slipped on or off the harmonica for easy disassembly and reassembly, such as when cleaning or maintaining the harmonica. The enclosure formed of two or more enclosure pieces also can be easily disassembled and reassembled.

BRIEF DESCRIPTION OF THE DRAWINGS

In the accompanying drawings, I have illustrated present preferred embodiments of my invention in which.

DESCRIPTION OF THE PREFERRED EMBODIMENTS

Figure 1:
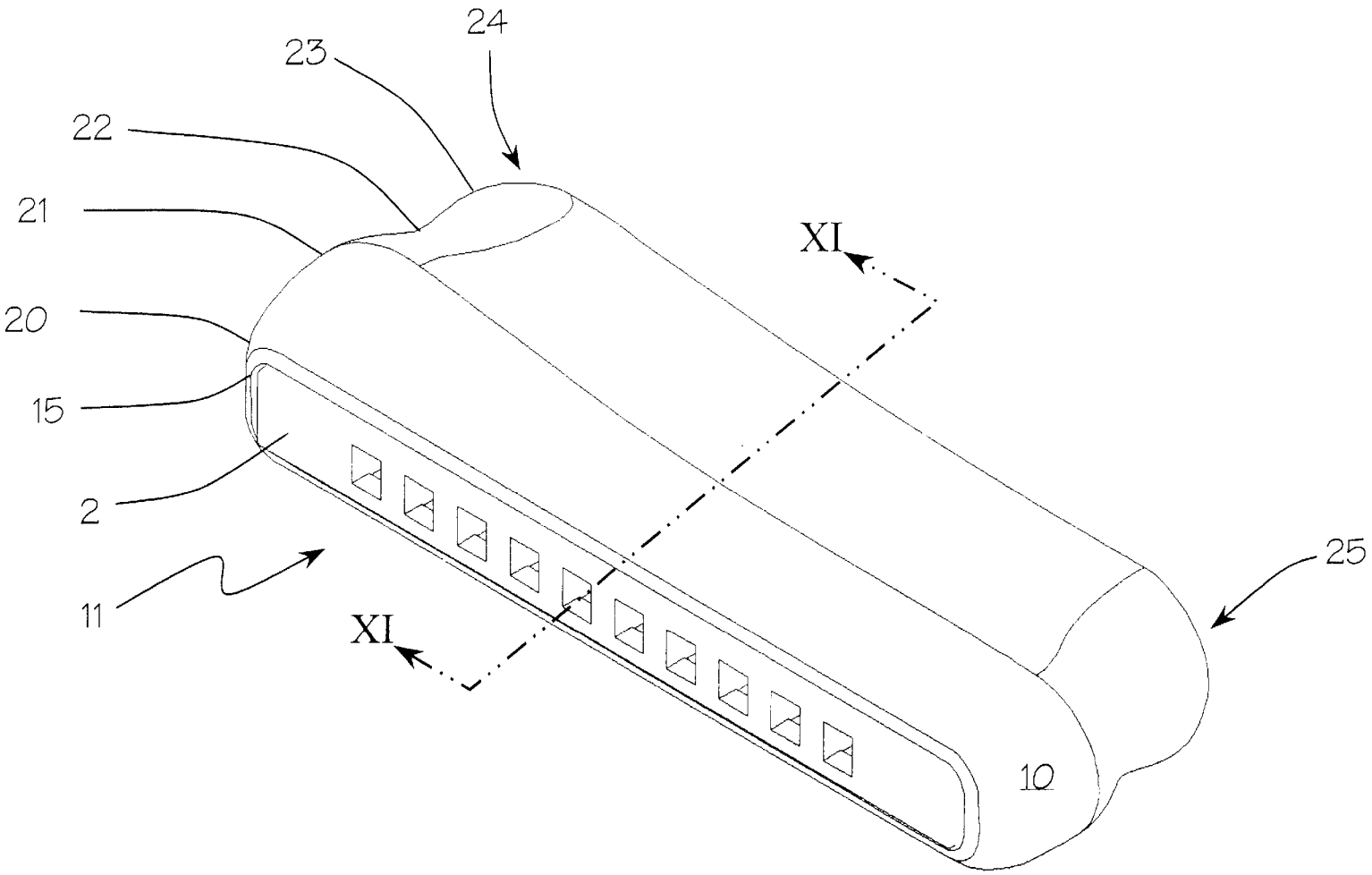
FIG. 1 is a front isometric view of an enclosure embodying the present invention with a harmonica positioned within the enclosure.
Figure 2:
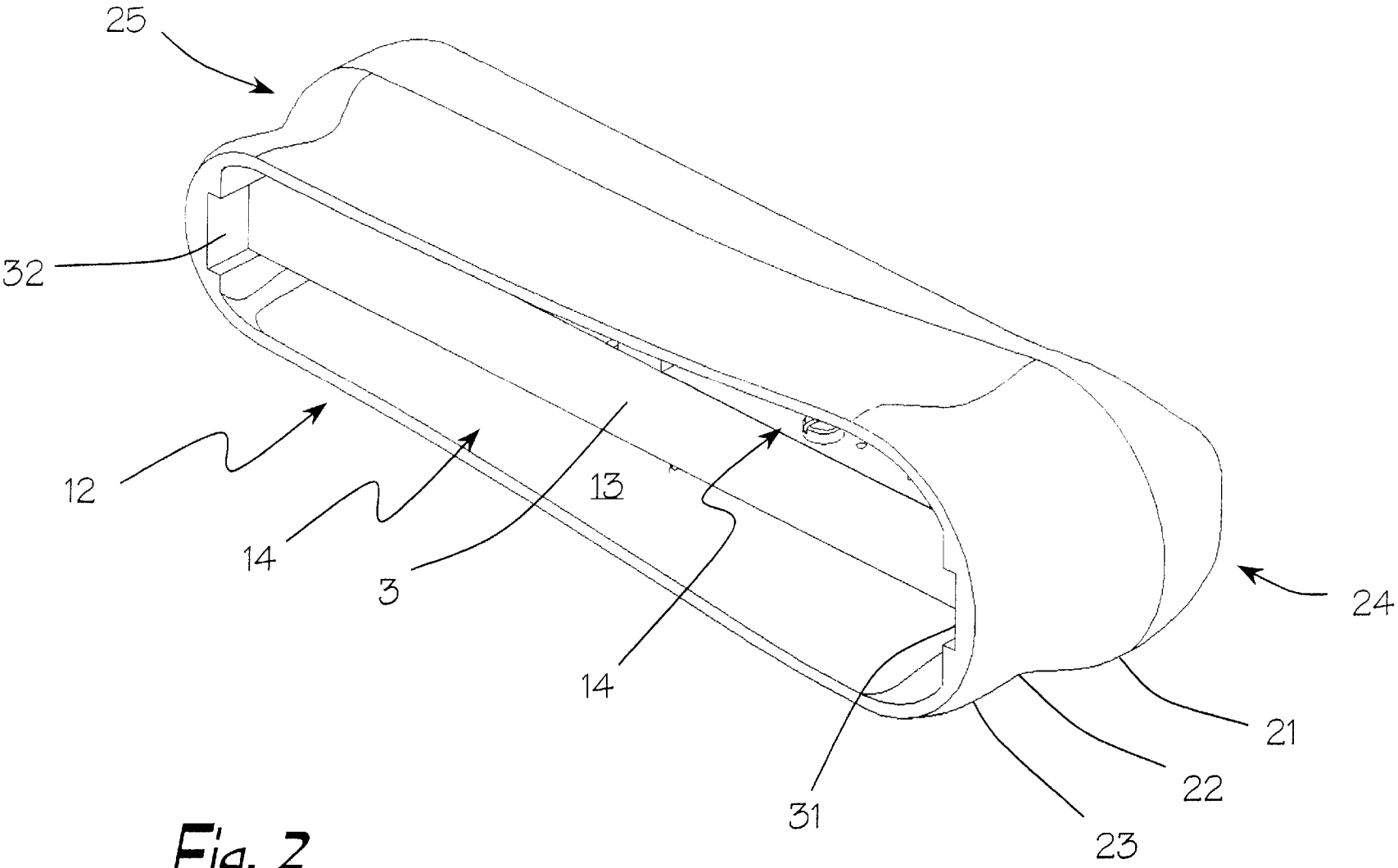
FIG. 2 is a rear isometric view the enclosure shown in FIG. 1.

Referring now to FIGS. 1 and 2, the enclosure of the present invention is shown with a diatonic harmonica positioned within the enclosure. The enclosure is fabricated of any material, preferably injection molded plastic or injection molded stainless steel. A portion of the outer surface of the wall of the enclosure is depicted generally at 10. The mouthpiece opening in the first or front face of the enclosure is depicted at 11, in juxtaposition with the mouthpiece of the harmonica at 2. It can be appreciated that the mouthpiece protrudes sufficiently from the mouthpiece opening to permit access by the mouth of the player to the mouthpiece during use. The outlet opening in the second or rear face is depicted at 12. A portion of the inner surface of the wall of the enclosure is depicted at 13. Portions of supporting members in the form of supporting grooves formed on the inner surface are shown at 31 and 32. It can be appreciated that the supporting grooves constrain the movement of the harmonica within the enclosure. It can also be appreciated that the player can grip the enclosure with one or both hands and thereby hold the enclosure and the harmonica.

As shown in FIG. 2, the inner surface of the wall of the enclosure is spaced away from the harmonica except where supporting members of the enclosure abut the harmonica, forming the resonance chambers depicted at 14. Every reed slot communicates with a resonance chamber. It can be appreciated that such communication of reed slots, resonance chambers and outlet opening permits the player to produce sound from the harmonica during play by blowing and drawing.

Figure 3:
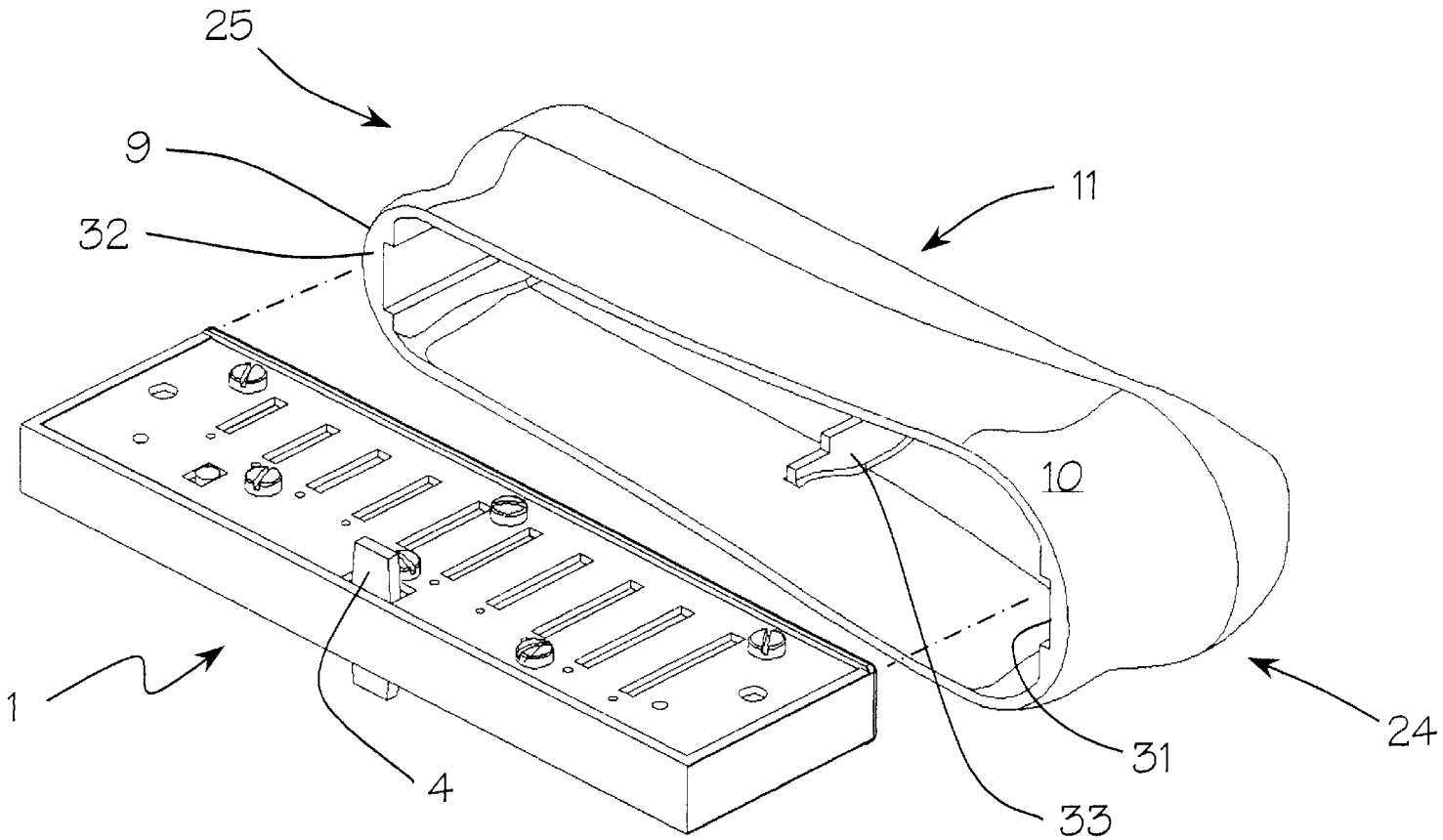
FIG. 3 is an isometric view of another enclosure embodying the present invention and a harmonica ready to be positioned within the enclosure.

Referring now to FIG. 3, the wall 9 is of varying thickness at different points of the enclosure. It can be appreciated that the shape and dimensions of the outer surface of the wall can accommodate various shapes and dimensions of the inner surface so that the acoustic effects of the shape and dimensions of the inner surface can be optimized within the limits imposed by the outer surface. Furthermore, portions of the wall can be made thicker in places to supply rigidity to the enclosure.

Referring again to FIG. 3, it can be appreciated that the varying thickness of the wall permits supporting members to be formed as protrusions of the inner surface or as recesses in the inner surface of the wall which abut the harmonica positioned within the enclosure. Supporting members formed on the inner surface of the wall in the form of supporting grooves are depicted at 31 and 32. A supporting member formed on the inner surface of the wall in the form of a rib is depicted at 33.

As shown in FIG. 1, the lip groove 20 of the enclosure adjacent to the mouthpiece opening 11 forms in conjunction with the mouthpiece of the harmonica a smooth surface. It can be appreciated that during play the player's lips may press against the smooth surface formed by the lip groove and harmonica mouthpiece. The wall of the enclosure contacts the harmonica along the edge 15 of the mouthpiece opening and/or along the inner surface of the lip groove 20 forming a substantially airtight seal between the enclosure and the harmonica. It can be appreciated that such seal facilitates channeling of air blown or drawn by the player into or out of the harmonica through the openings in the mouthpiece rather than over the outside of the reed plates of the harmonica.

As shown in FIG. 1, the bulge 21, cradle 22 and diffuser 23 form a shape which is concave in the front-to-back axis, that is, in the direction of the axis running from the mouthpiece opening to the outlet opening, and which is convex in the plane perpendicular to the front-to-back axis around each end of the enclosure. It can be appreciated that the concave shape formed by the bulge 21, cradle 22 and diffuser 23 provides an ergonomic niche for the thumb, finger or fingers, and hand tissue between the thumb and first finger of the player's gripping hand to rest in, while the convex shape around the bass end 24 forms a smooth curve which rests easily in the tissue of the player's hand between the base of the thumb and the base of the first finger. Specifically, the thumb, finger or fingers, and hand tissue between the thumb and first finger can contact the cradle 22 and adjacent portions of the bulge 21 and the diffuser 23, with the bulge 21 and diffuser 23 constraining front-to-back movement of the enclosure and harmonica relative to the gripping hand. Alternatively, the player can place the fingers and thumb of the gripping hand in different positions relative to the bulge 21, cradle 22 and diffuser 23 to accommodate different playing styles, to achieve different acoustic effects, or to achieve a better match between the size and shape of the player's gripping hand and the outer surface of the enclosure.

It can also be appreciated that the front-to-back concave shape and transverse convex shape of the bulge 21, cradle 22 and diffuser 23 facilitate formation of an airtight seal between the player's gripping hand and the enclosure. Such an airtight seal improves the acoustic effect of the playing technique known as cupping. It can be appreciated that the enclosure further facilitates cupping by providing a smoothly curved outer surface upon which to rest fingers of the gripping hand and of the player's other hand while in a cupping formation. Furthermore, the player's non-gripping hand while cupping can easily and comfortably make a substantially airtight seal against the smooth curve of the outlet opening 12 at the treble end 25 shown in FIG. 2.

Figure 4:
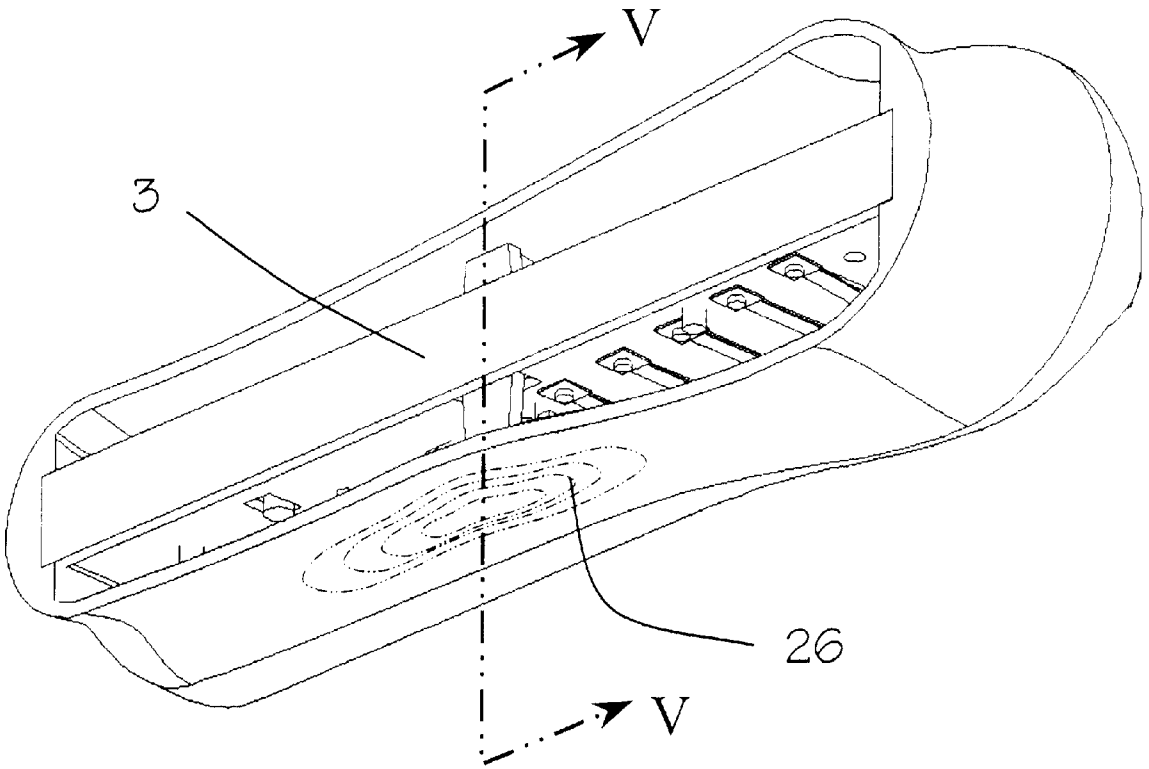
FIG. 4 is an isometric view of another enclosure embodying the present invention with a harmonica positioned within the enclosure.

Referring now to FIG. 4, an indentation in the cradle on the underside of the enclosure is shown at 26. It can be appreciated that the indentation 26 accommodates the middle joint of the thumb of the player's gripping hand, which improves gripping comfort and facilitates formation of a substantially airtight seal between the thumb and the enclosure during cupping.

Referring now to FIGS. 1 and 2, the bulge 21, cradle 22 and diffuser 23 taper from a greater height at the bass (lower-pitched) end 24 to a lesser height at the treble (higher-pitched) end 25. The tapering of the enclosure accommodates the heights of the respective portions of the resonance chambers 14 in nearest communication with the reed slots that generate the bass notes, intermediate notes and treble notes, respectively, also tapering from larger to smaller. It can be appreciated that such tapering acoustically matches the size of the portions of the resonance chamber to the corresponding notes. It can also be appreciated that the bass end can easily be distinguished from the treble end by cursory visual or tactile perusal of the enclosure so that a player can quickly achieve the correct playing orientation of the harmonica immediately upon picking it up without first closely inspecting it. The lesser height to which the bulge, cradle and/or diffuser taper at the treble end can be so small and uniform as to provide a substantially flat outer surface of the portion of the wall of the enclosure at the treble end.

The preferred maximum height of the bulge ranges from 150% to 350% of the height of the mouthpiece opening. In one preferred embodiment, the bulge has a maximum height of 270% of the mouthpiece opening at the bass end and 155% at the treble end. The preferred width of the bulge ranges from 101% to 120% of the width of the mouthpiece opening. In one preferred embodiment, the bulge has a width of 112% of the width of the mouthpiece opening.

The preferred maximum height of the cradle ranges from 50% to 90% of the height of the bulge. In one preferred embodiment, the cradle has a maximum height of 80% of the height of the bulge at the bass end and 92% at the treble end. The preferred width of the cradle ranges from 80% to 99% of the width of the bulge. In one preferred embodiment, the cradle has a width of 93% of the width of the bulge.

The preferred maximum height of the diffuser ranges from 101% to 150% of the height of the cradle. In one preferred embodiment, the diffuser has a maximum height of 112% of the height of the cradle at the bass end and 115% at the treble end. The preferred width of the diffuser ranges from 101% to 120% of the width of the cradle. In one preferred embodiment, the diffuser has a width of 101% of the width of the cradle.

Referring now to FIG. 2, the outlet opening 12 has lesser height and width than the diffuser 23. The dimensions of the outlet opening constrict the resonance chamber at the outlet opening. It can be appreciated that the constriction of the outlet opening provides back pressure and modifies the tonal constitution of the sound. Alternatively, the outlet opening can be located at the contour of maximum height of the diffuser, with no constriction in height and width relative to the diffuser.

Referring now to FIG. 2, the outlet opening 12 tapers from a greater height at the bass end 24 to a lesser height at the treble end 25. It can be appreciated that this tapered shape of the outlet opening can correspond a tapered shape in the bulge, cradle and diffuser. The preferred range of height of the outlet opening ranges from 80% to 90% of the height of the diffuser. In one preferred embodiment, the height of the outlet opening is 95% of the height of the diffuser at the bass end and 94% at the treble end. The preferred width of the outlet opening ranges from 90% to 99% of the width of the diffuser. In one preferred embodiment, the width of the outlet opening is 96% of the width of the diffuser.

Figure 5:
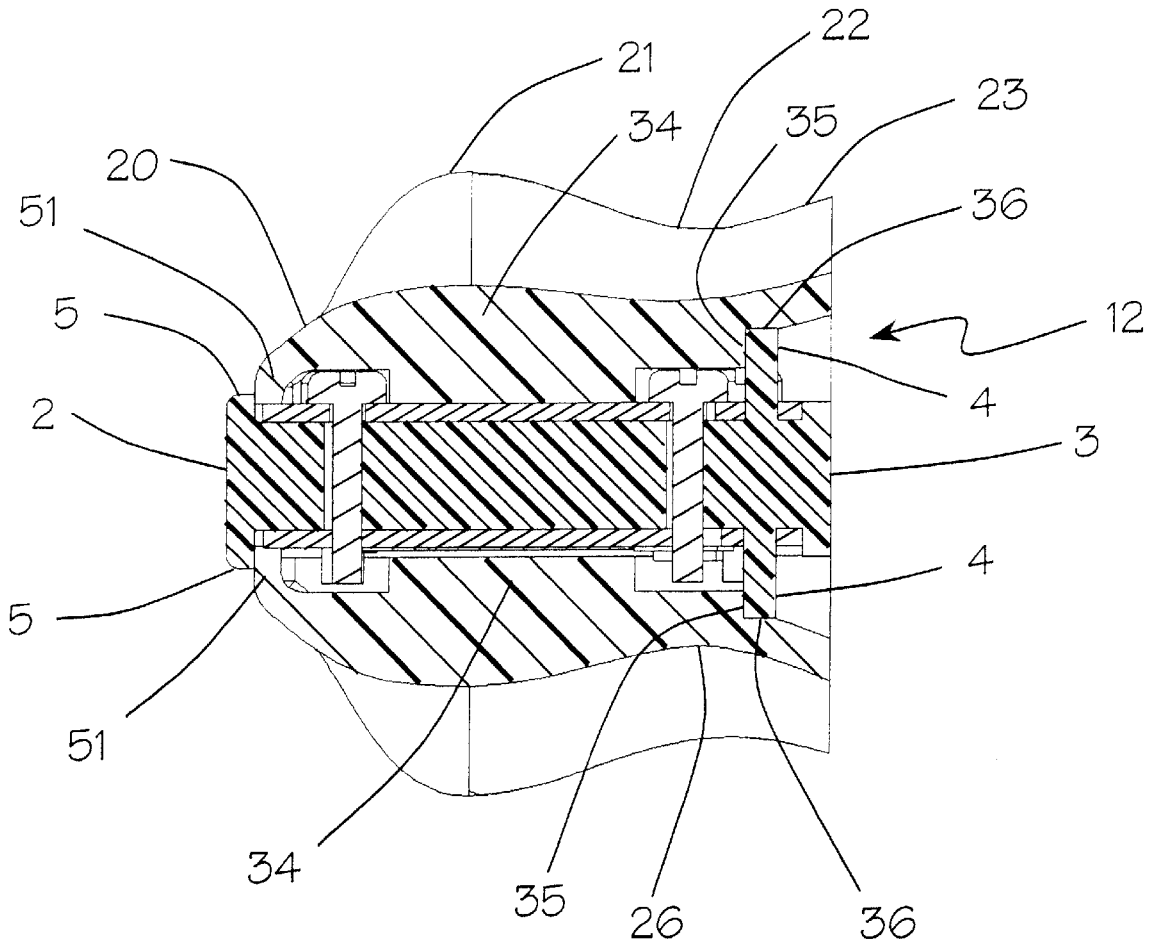
FIG. 5 is a sectional view taken along the line V—V of FIG. 4.
Figure 6:
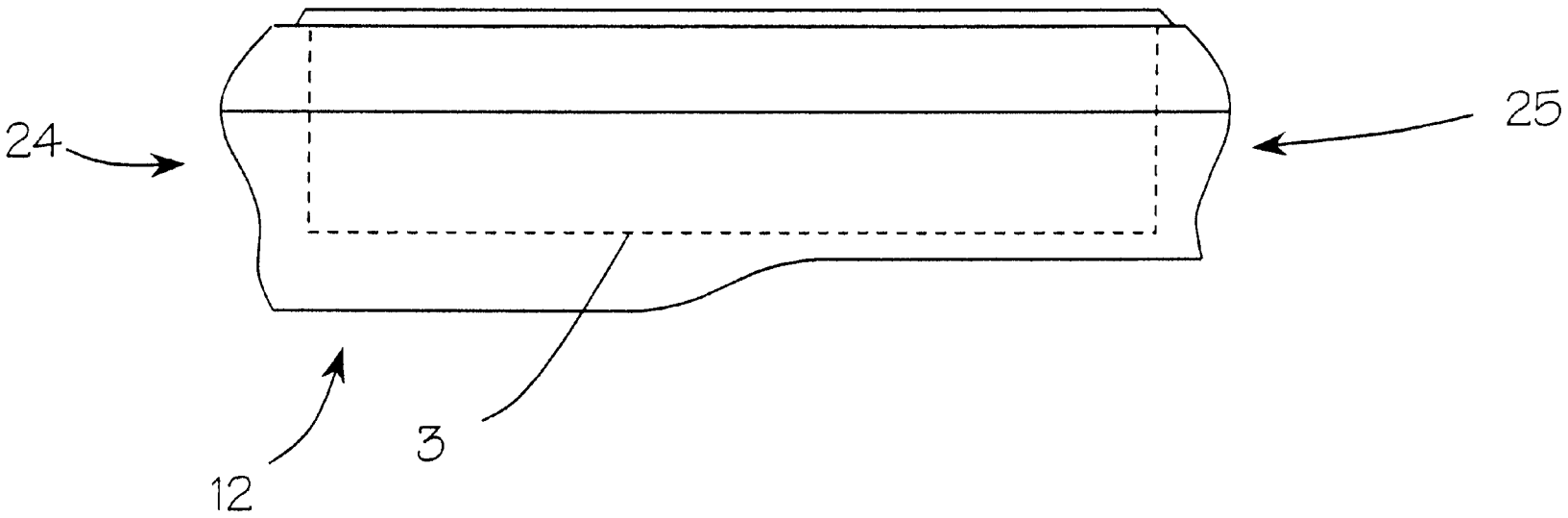
FIG. 6 is a plan view of another enclosure embodying the present invention.
Figure 11:
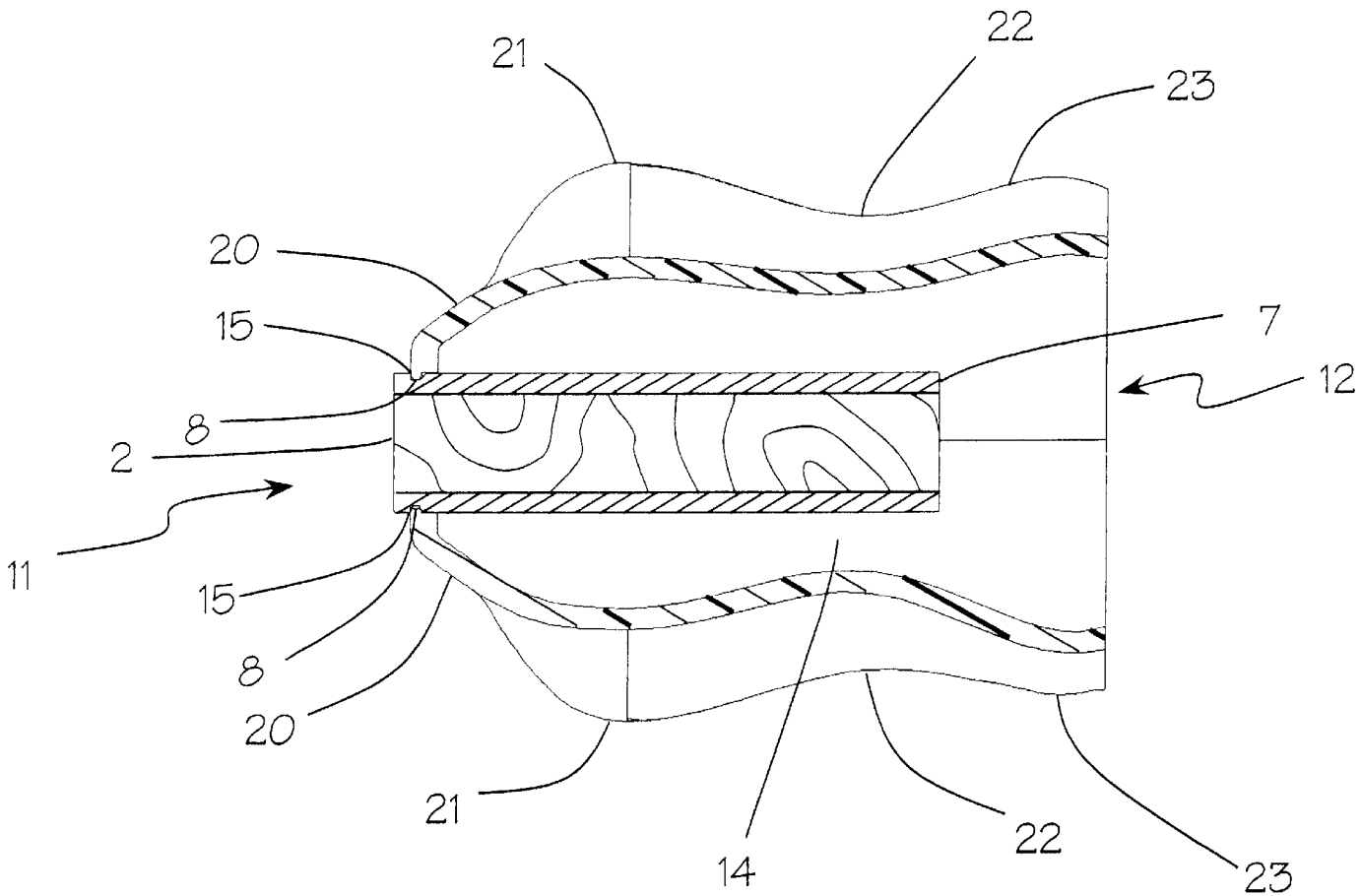
FIG. 11 is a sectional view taken along line XI—XI of FIG. 11.

Referring now to FIGS. 4 and 5, in one embodiment the outlet opening 12 is flush with the rear face 3 of the harmonica (the face opposite the mouthpiece face). Referring now to FIGS. 2 and 11, in another embodiment the outlet opening 12 is located to the rear of the rear face 3 of the harmonica so that the enclosure extends rearward beyond the rear face of the harmonica. It can be appreciated that such location of the outlet opening results in larger resonance chambers 14. The preferred range of locations of the outlet opening measured from the mouthpiece of the harmonica is from 100% to 120% of the distance from the mouthpiece of the harmonica to the rear face of the harmonica. Referring now to FIG. 6, the outlet opening 12 at the bass end 24 is located further to the rear of the rear face 3 of the harmonica than is the outlet opening at the treble end 25. In one preferred embodiment, the portion of the outlet opening 12 intermediate between the bass end 24 and the treble end 25 smoothly curves in a sigmoidal curve from the bass end to the treble end. It can be appreciated that the shape of the enclosure so formed improves the seal between the player's cupping hand and the outlet opening, and further graduates the volume of the resonance chambers in decreasing fashion from the bass end to the treble end.

Referring now to FIGS. 2 and 3, the inner surface of the enclosure has two supporting grooves 31 and 32 as supporting members. The first supporting groove 31 is located at the bass end of the enclosure and the second supporting groove 32 is located at the treble end 25 of the enclosure. Each supporting groove is shaped to abut and mate with the corresponding end of the harmonica. It can be appreciated that the supporting grooves support the harmonica within the enclosure and constrain movement of the harmonica relative to the enclosure along the vertical axis and along the left-right axis, and, to a limited degree by means of friction, along the front-back axis.

Referring now to FIG. 3, the enclosure is formed in one piece. In this one-piece embodiment, the supporting grooves 31 and 32 extend from the mouthpiece opening 11 in the direction of the outlet opening 12. It can be appreciated that the supporting grooves permit the enclosure to be slid along the harmonica from the mouthpiece face of the harmonica into playing position and permit the enclosure to be removed from the harmonica by sliding the enclosure in the opposite direction. In can also be appreciated that the enclosure can be slid onto a harmonica without a tang from the rear face of the harmonica and the enclosure can be removed from such a harmonica by sliding the enclosure in the opposite direction.

Figure 7:
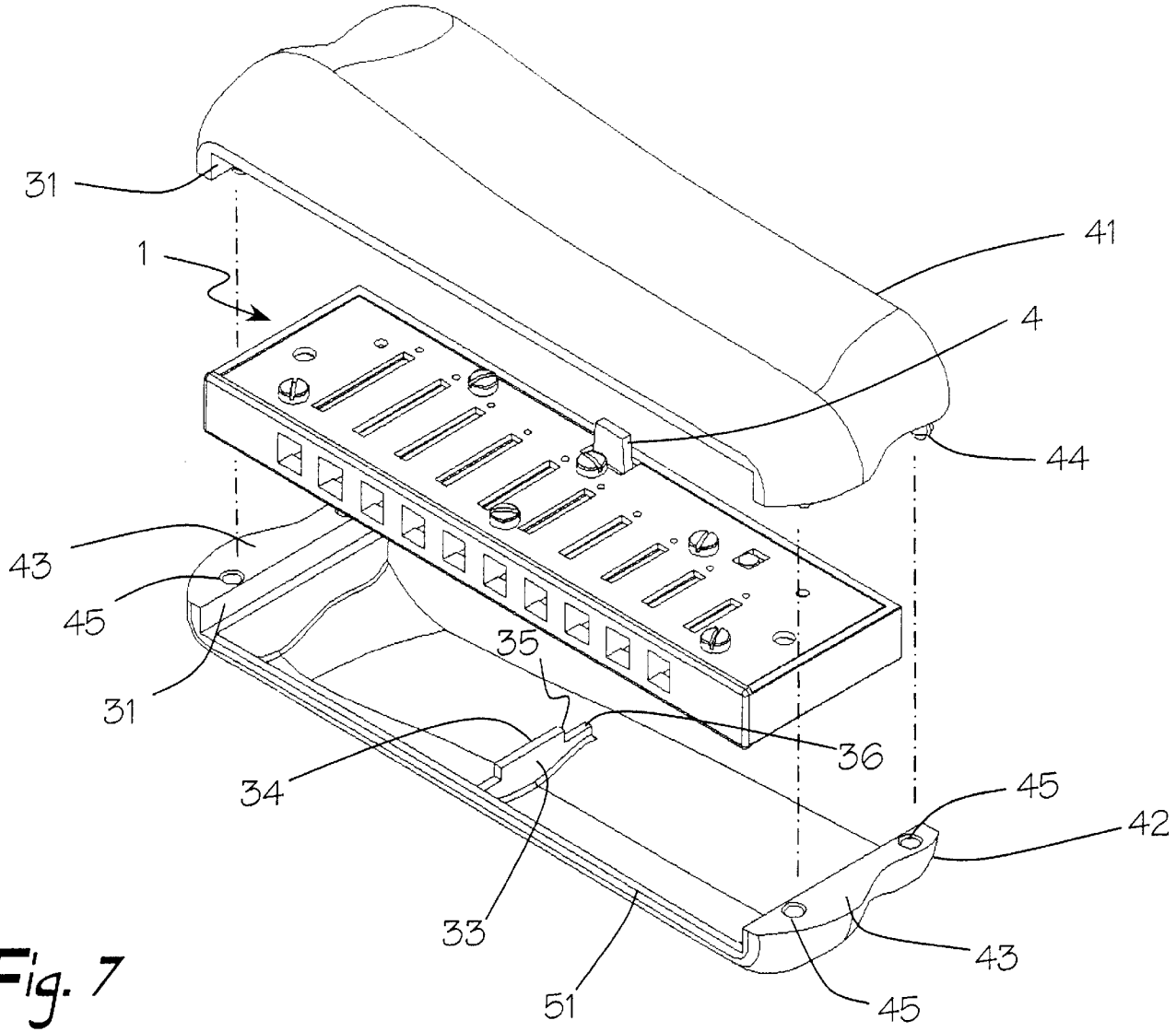
FIG. 7 is a front exploded isometric view of a two-piece enclosure embodying the present invention with a harmonica to be positioned within the enclosure.
Figure 8:
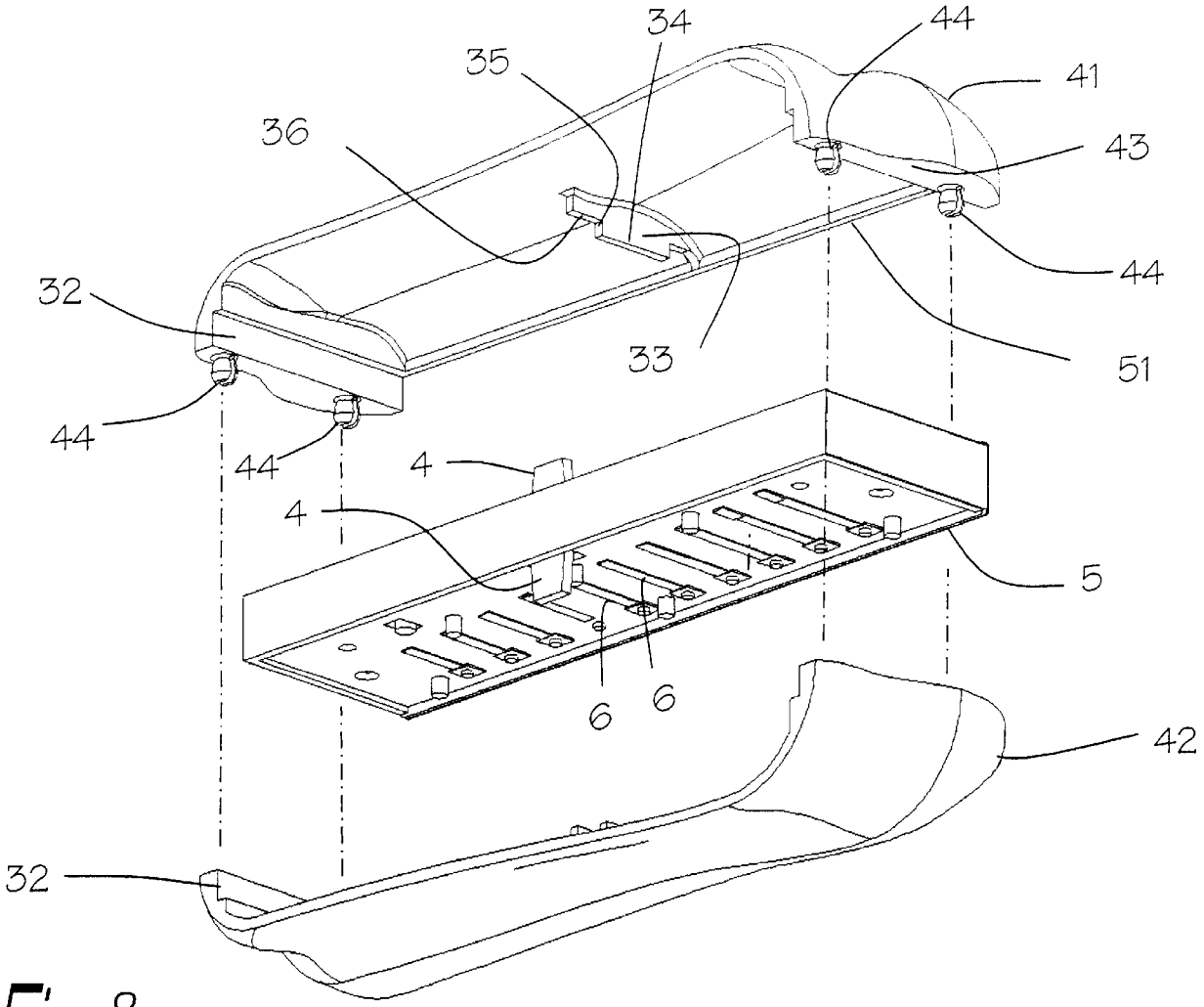
FIG. 8 is a rear exploded isometric view of the enclosure shown in FIG. 7.

In another embodiment shown in FIGS. 7 and 8, the enclosure is formed of two enclosure pieces 41 and 42, each with joining surfaces 43 shaped to abut the joining surfaces 43 of the other enclosure piece. When joined together, the two enclosure pieces 41 and 42 form the wall of the enclosure with its inner surface and outer surface, including the supporting grooves 31 and 32 and ribs 33 on the inner surface. FIGS. 7 and 8 show one enclosure piece 41 with two joining surfaces 43 with snaps 44 protruding and another enclosure piece 42 with two joining surfaces 43 with sockets 45 recessed in the joining surfaces. It can be appreciated that the two enclosure pieces can be joined by means of the snaps 44 and sockets 45 with the harmonica positioned within the enclosure and can be separated for cleaning or maintenance of the enclosure and the harmonica. It can also be appreciated that other joining means can be substituted in place of joining surfaces having snaps and sockets.

Figure 10:
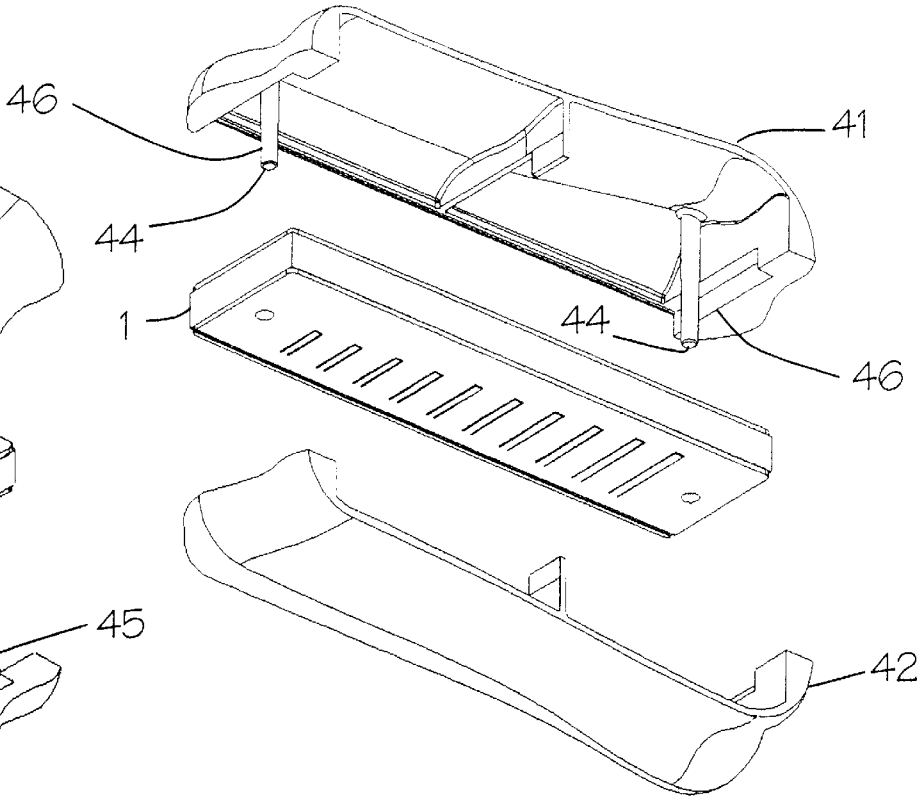
FIG. 10 is a rear exploded isometric view of the enclosure shown in FIG. 9.
Figure 9:
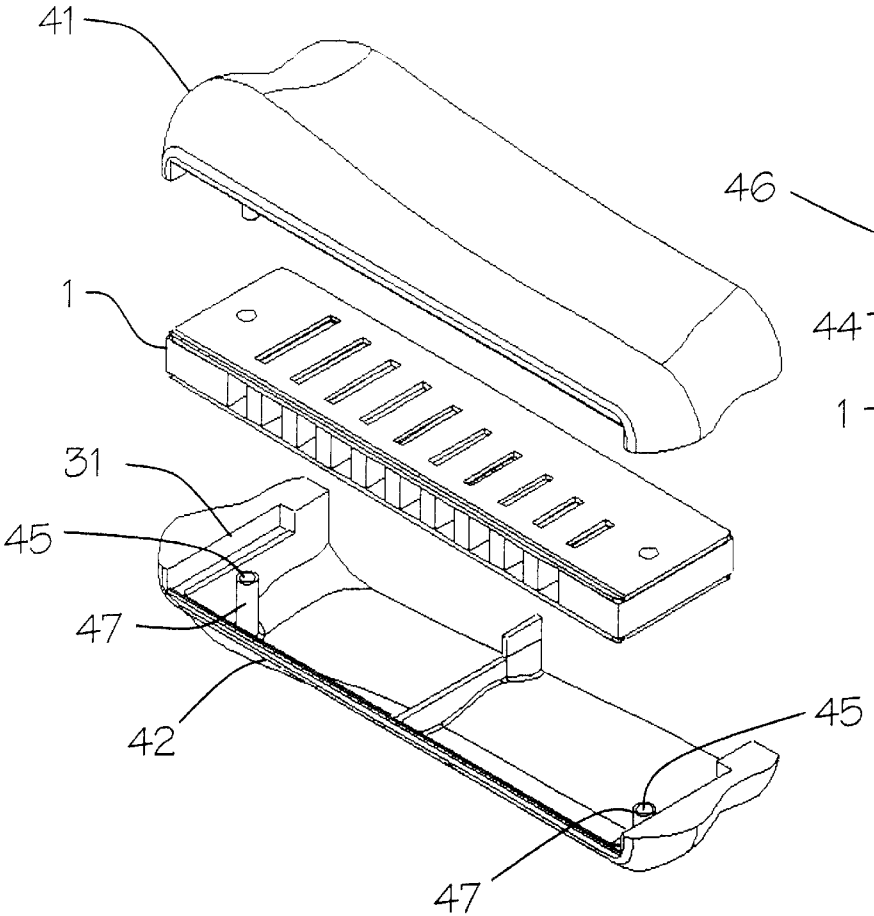
FIG. 9 is a front exploded isometric view of another two-piece enclosure embodying the present invention with a harmonica to be positioned within the enclosure.

In another embodiment shown in FIGS. 9 and 10, an enclosure formed of two enclosure pieces 41 and 42 has as joining means two long posts 46 protruding from the inner surface of one piece 41 which mate with two short posts 47 protruding from the other enclosure piece 42. It can be appreciated that a snap 45 located in the respective end of each long post 46 distal from the wall fits into a socket 45 located at the respective end of each short post 47 to secure the two enclosure pieces together. The long posts 46 are of sufficiently thin diameter and positioned to project through holes in the harmonica body positioned within the assembled enclosure. It can be appreciated that the long posts 46 also serve to constrain movement of the harmonica relative to the enclosure in the direction of the mouthpiece opening, in the direction of the outlet opening, in the direction of the bass end and in the direction of the treble end.

The enclosure can be made of any material or a combination of materials bonded together. In one preferred embodiment, the material is injection-molded plastic.

Referring now to FIGS. 7 and 8, the inner surface has two ribs 33 as supporting members. Each rib 33 has a linear shape aligned parallel to the nearest reed slots 6 of the harmonica with a first segment 34 which abuts the harmonica between two adjacent reed slots 6. Each rib has a face 35 located along the rib facing away from the mouthpiece opening which abuts the face of the harmonica tang 4 which faces in the direction of the mouthpiece of the harmonica. It can be appreciated that the first segment of each rib supports the harmonica without interfering with the vibrating reeds in the reed slots or obstructing the flow of air through the reed slots, and constrains movement of the harmonica relative to the enclosure along a vertical axis. It can also be appreciated that the face 35 of each rib constrains movement of the harmonica relative to the enclosure in a direction toward the mouthpiece opening. FIGS. 7 and 8 also show a second segment 36 of each rib located further distal from the mouthpiece opening than the rib face 35, which second segment 36 abuts the end of the tang 4 of the harmonica. It can be appreciated that the second segment 36 supports the harmonica and constrains movement of the harmonica relative to the enclosure along a vertical axis.

Referring now to FIG. 5, an embodiment of the enclosure for use with a harmonica having a raised lip 5 adjacent to the mouthpiece has a web 51 located along the edge 15 of the mouthpiece opening 11 which abuts the raised lip 5. It can be appreciated that the web 51 forms a stop that constrains movement of the harmonica relative to the enclosure in the direction of the outlet opening 11 and forms a substantially airtight seal between the edge 15 of the mouthpiece opening of the enclosure and the harmonica positioned within the enclosure.

Referring now to FIG. 11, an embodiment of the enclosure for use with a harmonica having a groove 8 in the reed plate 7 adjacent to the mouthpiece 2 has the edge 15 of the mouthpiece opening formed to fit into the groove 8 in the reed plate. It can be appreciated that the edge 15 of the mouthpiece opening forms a stop that constrains movement of the harmonica relative to the enclosure in the direction of the outlet opening 11 and in the direction of the mouthpiece opening 12 and forms a substantially airtight seal between edge 15 of the mouthpiece opening of the enclosure and the harmonica positioned within the enclosure.

Figure 12:
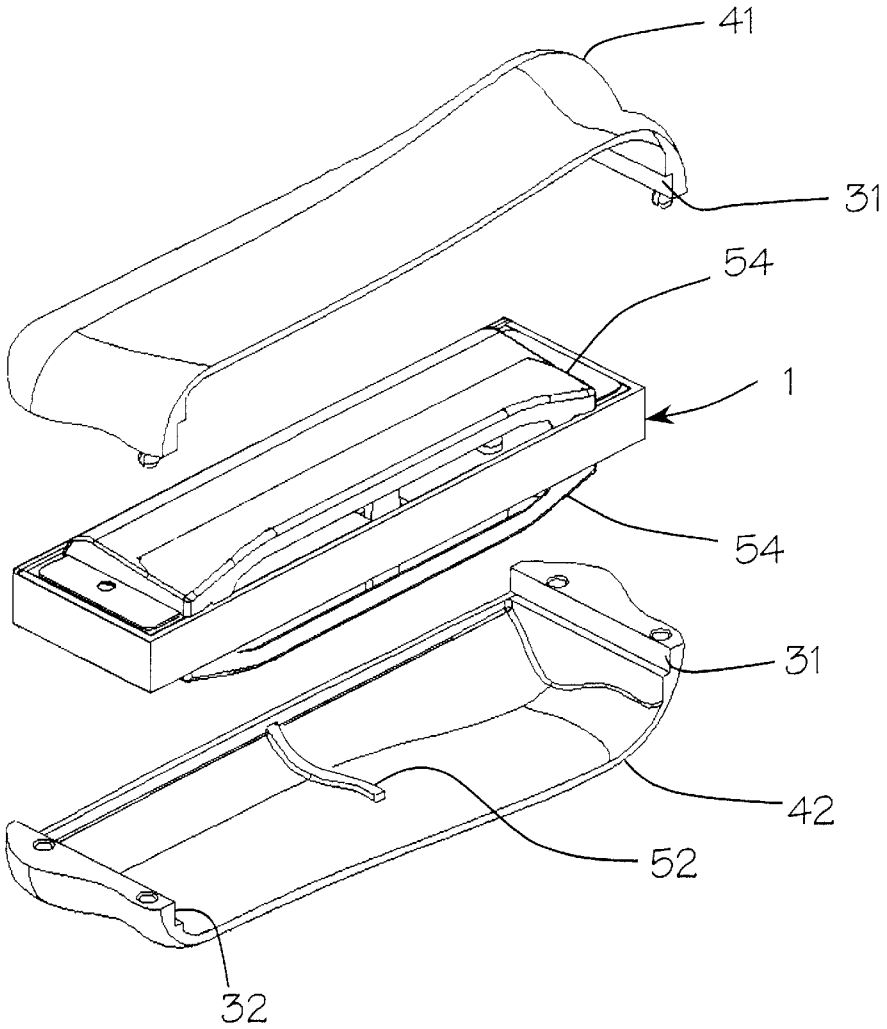
FIG. 12 is a rear exploded isometric view of another enclosure embodying the present invention with a harmonica with existing cover plates to be positioned within the enclosure.

FIGS. 1 through 11 show embodiments of the enclosure for use with a harmonica that lacks existing cover plates and has a reed comb and an upper reed plate and a lower reed plate. FIG. 12 shows an embodiment of the enclosure with a harmonica with existing cover plates 54 positioned within the enclosure. Supporting members 52 are structured to accommodate and support the harmonica with existing cover plates. It can be appreciated that a player can readily switch between playing the harmonica without the enclosure and playing the harmonica within the enclosure, and so switch between the different acoustic effects achievable in each case, without having to disassemble and reassemble the harmonica to remove or install the existing cover plates.

Figure 13:
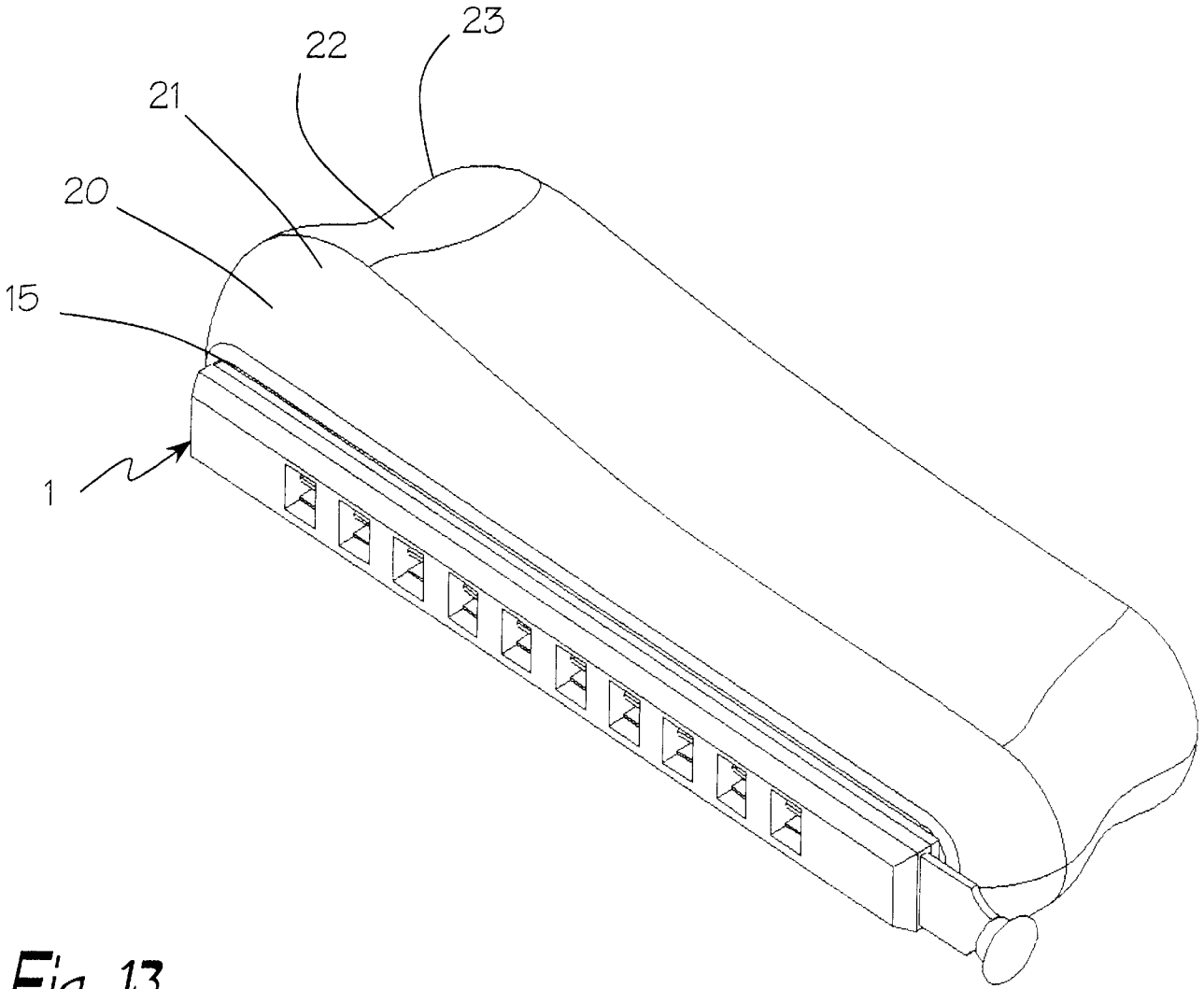
FIG. 13 is a front isometric view of another enclosure embodying the present invention with a chromatic harmonica positioned within the enclosure.

FIGS. 1 through 12 show embodiments of the enclosure for use with a diatonic harmonica. As shown in FIG. 13, the enclosure can be used with a chromatic harmonica.

Whereas certain terms of relative orientation such as "vertical" or "rear" have been used herein to describe the invention, these terms are intended for purposes of illustration only and are not intended to limit the scope of the present invention. In addition, while specific embodiments of the invention have been described in detail, it will be appreciated by those skilled in the art that various qualifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An enclosure for a harmonica including a tang, said enclosure comprising a wall with an inner surface and an outer surface;

a mouthpiece having an opening, said mouthpiece opening formed in a first face of the enclosure, said mouthpiece opening having an edge with the edge of the mouthpiece opening being in juxtaposition to the mouthpiece of the harmonica positioned within the enclosure;

an outlet opening formed in the enclosure in a second face opposite from the first face, the outlet opening being of varying size and larger at one end than at the other end;

the inner surface of the wall of the enclosure being spaced away from the harmonica between the mouthpiece opening and the outlet opening whereby at least one resonance chamber is formed within the enclosure;

each resonance chamber being in communication with the outlet opening and in communication with at least one reed slot of the harmonica;

each reed slot of the harmonica communicates with at least one of said resonance chambers; and at least one support member formed on the inner surface of the wall positioned to abut the harmonica and constraining movement of the harmonica within the enclosure.

2. The enclosure of claim 1, in which the wall is of varying thickness; and the inner and outer surfaces each have contours, said contours being dissimilar.

3. The enclosure of claim 2, in which the wall includes a lip groove adjacent to the mouthpiece opening, a bulge located adjacent to the lip groove and curved further away from the harmonica than the lip groove, a cradle located adjacent to the bulge distal from the lip groove and curving closer to the harmonica body than the bulge, and a diffuser located adjacent to the cradle distal from the bulge and curving further away from the harmonica body than the cradle, whereby the outer surface of the wall is shaped for convenient gripping by the hand of a player.

4. The enclosure of claim 3, in which the bulge having a maximum height between 150% and 350% of the height of the mouthpiece opening;

the bulge having a width between 101% and 120% of the width of the mouthpiece opening;

the cradle having a maximum height between 50% and 99% of the height of the bulge;

the cradle having a width between 80% and 99% of the width of the bulge;

the diffuser having a maximum height between 101% and 150% of the height of the cradle; and the diffuser having a width between 101% and 15% of the width of the cradle.

5. The enclosure of claim 3, in which the enclosure has a bass end corresponding to the bass end of the harmonica and a treble end corresponding to the treble end of the harmonica;

the bulge tapers from a greater height at the bass end to a lesser height at the treble end;

the cradle tapers from a greater height at the bass end to a lesser height at the treble end; and the diffuser tapers from a greater height at the bass end to a lesser height at the treble end.

6. The enclosure of claim 3, in which the cradle has an indentation formed to accommodate the middle joint of a player's thumb.

7. The enclosure of claim 3, in which the outlet opening is of lesser height and width than the diffuser.

8. The enclosure of claim 7, in which the outlet opening has a height between 80% and 90% of the height of the diffuser; and the outlet opening has a width between 90% and 96% of the width of the diffuser.

9. The enclosure of claim 7, in which the enclosure has a bass end corresponding to the bass end of the harmonica and a treble end corresponding to the treble end of the harmonica;

the outlet opening tapers from a greater height at the bass end to a lesser height at the treble end.

10. The enclosure of claim 2, in which the inner surface has a first supporting groove conforming to the shape of and contacting one end of the harmonica and a second supporting groove conforming to the shape of and contacting an opposed end of the harmonica.

11. The enclosure of claim 2, in which at least one rib protrudes from the inner surface;

the rib is positioned linearly in a direction pointing away from the mouthpiece opening;

the rib has a first segment and a face located distal from the front mouthpiece;

the first segment is located closer to the mouthpiece opening than the face of the rib and abuts the harmonica; and the face of the rib abuts the face of the tang of the harmonica that faces in the same direction as the mouthpiece, and forms a stop constraining movement of the harmonica relative to the enclosure in the direction of the mouthpiece opening.

12. The enclosure of claim 11, in which the rib has a second segment located opposite from the first segment which abuts the end of the tang of the harmonica.

13. The enclosure of claim 1, in which the outlet opening is located further away from the mouthpiece opening than the face of the harmonica opposite the mouthpiece.

14. The enclosure of claim 13, in which the outlet opening is located a distance from the mouthpiece opening of up to 120% of the distance between the mouthpiece of the harmonica and the face of the harmonica opposite the mouthpiece.

15. The enclosure of claim 13, in which the enclosure has a bass end corresponding to the bass end of the harmonica and a treble end corresponding to the treble end of the harmonica; and the outlet opening is located further away from the mouthpiece opening at the bass end than at the treble end.

16. The enclosure of claim 1, in which the inner surface has a web located along the edge of the mouthpiece opening which abuts the raised lip of the harmonica located adjacent to the mouthpiece of the harmonica, and forms a stop structured to constrain movement of the harmonica relative to the enclosure in the direction of the outlet opening.

17. The enclosure of claim 1, in which the harmonica includes a reed plate defining a groove, said groove located adjacent to the mouthpiece of the harmonica; and the edge of the mouthpiece opening is formed to contact the groove and form a stop structured to constrain movement of the harmonica relative to the enclosure in the direction of the outlet opening.

18. The enclosure of claim 1, in which said harmonica has a mouthpiece face; and the enclosure is formed in one piece structured to be slid onto the harmonica from the mouthpiece face of the harmonica.

19. The enclosure of claim 1, in which said harmonica has (i) a mouthpiece face and (ii) a second face opposite said mouthpiece face; and the enclosure is formed in one piece structured to be slid onto the harmonica from said second face.

20. The enclosure of claim 1, in which the enclosure has at least two enclosure pieces structured to be fit together to form the enclosure; and each enclosure piece has joining means to secure the enclosure pieces to each other.

21. The enclosure of claim 20, in which the joining means comprises a plurality of joining surfaces on the enclosure pieces;

each joining surface has at least one socket recessed into the joining surface or at least one snap protruding from the joining surface; and each of the joining surfaces of each enclosure piece contacts at least one joining surface of at least one other enclosure piece, with the snaps and the sockets being structured for holding the enclosure pieces together and structured for being joined or separated.

22. The enclosure of claim 21, in which each enclosure piece has at least one long post having a free end or at least one short post having a free end, said posts protruding from its inner surface;

each long post is positioned to be inserted through a hole in the harmonica positioned within the enclosure; and a joining surface is located at the free end of each post distal from the inner surface.

* * * * *

UNITED STATES PATENT AND TRADEMARK OFFICE

CERTIFICATE OF CORRECTION

PATENT NO. : 6,291,751 B1
DATED : September 18, 2001
INVENTOR(S) : James F. Antaki It is certified that error appears in the above-identified patent and that said Letters Patent is hereby corrected as shown below:

Column 8,
Line 62, "15%" should read -- 150% --.

Signed and Sealed this

Twenty-first Day of May, 2002

*Attest:*

*Attesting Officer*

JAMES E. ROGAN
*Director of the United States Patent and Trademark Office*